US006681983B2

(12) United States Patent
Bill-Moore

(10) Patent No.: US 6,681,983 B2
(45) Date of Patent: Jan. 27, 2004

(54) PAPERBOARD BOX WITH REMOVABLE IDENTIFYING INDICIA

(75) Inventor: Leah M. Bill-Moore, Marion, OH (US)

(73) Assignee: Field Container Company L.P., OH (US)

( * ) Notice: Subject to any disclaimer, the term of this patent is extended or adjusted under 35 U.S.C. 154(b) by 0 days.

(21) Appl. No.: 09/949,916

(22) Filed: Sep. 12, 2001

(65) Prior Publication Data

US 2003/0047595 A1 Mar. 13, 2003

(51) Int. Cl.[7] ..... B65D 25/54

(52) U.S. Cl. ..... 229/162.3; 206/459.1; 206/459.5; 206/831; 229/162.1

(58) Field of Search ..... 229/162.1, 162.3; 206/459.1, 459.5, 831; 40/312, 674

(56) References Cited

U.S. PATENT DOCUMENTS

| | | | | | |
|---|---|---|---|---|---|
| 711,240 | A | | 10/1902 | Zaring | |
| 2,054,596 | A | | 9/1936 | Ford | |
| 2,194,220 | A | * | 3/1940 | Elder | 40/312 |
| 2,877,736 | A | * | 3/1959 | Simmons | 206/459.1 |
| 3,071,882 | A | * | 1/1963 | Eisman et al. | 40/312 |
| 3,155,273 | A | * | 11/1964 | Cote | 206/459.5 |
| 3,205,603 | A | * | 9/1965 | Brumley | 40/312 |
| 3,958,744 | A | * | 5/1976 | Herglotz | 206/831 |
| 4,004,691 | A | * | 1/1977 | Wihksne | 206/459.1 |
| 4,472,896 | A | * | 9/1984 | Brauner et al. | 40/312 |
| 4,630,733 | A | * | 12/1986 | Fear | 206/459.1 |
| 4,684,023 | A | * | 8/1987 | Cortopassi | 206/459.1 |
| 5,058,803 | A | * | 10/1991 | Gulliver | 229/148 |
| RE33,979 | E | | 6/1992 | Cortopassi | |
| 5,690,273 | A | * | 11/1997 | Jensen | 206/459.5 |
| 5,785,315 | A | | 7/1998 | Eiteneer et al. | |
| 6,041,997 | A | | 3/2000 | Jensen | |
| 6,047,881 | A | | 4/2000 | Clements et al. | |
| 6,068,181 | A | | 5/2000 | Cai | |

FOREIGN PATENT DOCUMENTS

| | | | | |
|---|---|---|---|---|
| DE | 934095 | * | 10/1955 | 206/459.5 |

* cited by examiner

*Primary Examiner*—Gary E. Elkins
(74) *Attorney, Agent, or Firm*—H. Jay Spiegel

(57) ABSTRACT

A paperboard box has removable identifying indicia. In a first embodiment, the top of the box has a central opening that may be rectangular in shape. Each corner of the opening has a removable tab and each of the tabs carries a different message. For example, the messages can relate to different kinds of pies such as, for example, "apple", "cherry", and "blueberry". One of the tabs may be provided with a line to provide a location where an identifier may be handwritten using any suitable writing instrument. As an alternative example, the writing on each tab may relate to an occasion such as "Happy Birthday", "Happy Anniversary", "Congratulations" or "Bon Voyage". A product is placed into the box and the cover is closed thereover. All of the tabs are removed with the exception of the remaining tab that accurately describes either the contents of the box or the occasion being celebrated or observed or other message. In a further embodiment, a box may be provided with a central opening having triangular or parallelogram-shaped tabs partially obscuring the opening. Each tab, as before, has indicia thereon concerning an occasion, the contents of the box or other message.

9 Claims, 2 Drawing Sheets

PAPERBOARD BOX WITH REMOVABLE IDENTIFYING INDICIA

BACKGROUND OF THE INVENTION

The present invention relates to a paperboard box with removable identifying indicia. In the baking industry, it is often necessary to hand mark a box, in a visible location, with indicia identifying the contents of the box, whether by type of pie, occasion celebrated, flavor or the like. Often, pies and cakes are mass produced and placed in identical containers. Thus, a system permitting easy identification of the contents of a box and an easy way of providing that marking would be helpful and would increase efficiency.

In the prior art, it is known to provide markings or indicia on boxes to facilitate identification of the contents of a box. Applicant is aware of the following United States Patents:

(1) U.S. Pat. No. 711,240 to Zaring discloses a box having indicia that may be covered to obscure indicia not indicative of the contents of the box.

(2) U.S. Pat. No. 2,054,596 to Ford discloses a carton having indicia printed on the side thereof and a flap that may be used to cover the indicia to change the indicated number.

(3) U.S. Pat. No. 3,071,882 to Eisman et al. discloses a carton with interchangeable identification means consisting of a foldable tab.

(4) U.S. Pat. No. 4,004,691 to Wihksne discloses a glove package box with interchangeable identification consisting of display windows that may be removed on perforations to reveal indicia behind the windows.

(5) U.S. Pat. No. 4,472,896 to Brauner et al. discloses a paperboard food carton having a lid with indicia printed thereon and with shutter panels that may be swung to reveal the desired indicium.

(6) Reissue Patent No. Re. 33,979 to Cortopassi discloses a content-identifying carton structure wherein a flap on the lid of the carton includes indicia and the body of the carton has tuck-tabs aligned with each indicium so that the tabs may be pivoted to reveal a desired indicium.

(7) U.S. Pat. No. 5,690,273 to Jensen discloses a paperboard container with indicia tabs wherein a tab may be folded to change the indicated identifier.

(8) U.S. Pat. No. 5,785,315 to Eiteneer et al. discloses a multi-layered gaming device wherein pieces are peeled off to reveal information located thereunder.

(9) U.S. Pat. No. 6,041,997 to Jensen discloses a paperboard clamshell construction in which a container lid has a peelable tab that, when removed, reveals indicium thereunder.

(10) U.S. Pat. No. 6,047,881 to Clements et al. discloses a contest container blank including tabs that may be peeled back to reveal information contained thereunder.

(11) U.S. Pat. No. 6,068,181 to Cai discloses a french fry carton with indicia hidden under a tab that may be torn away to reveal the indicia.

The present invention differs from the teachings of these patents as contemplating a paperboard container in which a plurality of separate tabs are provided on which are written different always visible indicia and wherein all of the areas except one are removed from the container at scoring lines to leave the remaining indicium on the container which accurately describes the contents thereof or provides a salutation, greeting or other message.

SUMMARY OF THE INVENTION

The present invention relates to embodiments of a paperboard box with removable identifying indicia. The present invention includes the following interrelated objects, aspects and features:

(1) In a first aspect, the present invention is intended to be incorporated into a box such as a paperboard box made from a sheet of card stock and appropriately scored and configured so that it may be bent at different areas thereon to form the bottom and cover, together comprising the box. Of course, the principles of the present invention may be equally well practiced with boxes made of other materials.

(2) In a first embodiment of the present invention, the top of the box or cover has a central opening that may, if desired, be rectangular in shape. Each corner of the opening has a removable tab and each of the tabs has written thereon a different message. For example, the messages can relate to different kinds of pies such as, for example, "apple", "cherry", and "blueberry". One of the tabs may be provided with a line to provide a location where an identifier may be handwritten using any suitable writing instrument.

(3) As an alternative example, the writing on each tab may relate to an occasion such as "Happy Birthday", "Happy Anniversary", "Congratulations" or "Bon Voyage".

(4) In using the inventive box, a product is placed into the box and the cover is closed thereover. All of the tabs are removed with the exception of the remaining tab that accurately describes either the contents of the box or the occasion being celebrated or observed or other message.

(5) In a further embodiment, a box may be provided with a central opening having triangular or parallelogram-shaped tabs partially obscuring the opening. Each tab, as before, has indicia thereon concerning an occasion, the contents of the box or other message. In operation of this embodiment, as before, all of the tabs are removed except for the tab that identifies the contents of the box or relates to the occasion being celebrated or observed or provides the desired message.

(6) In either embodiment of the present invention, the opening of the box cover may include a clear covering such as, for example, a transparent plastic covering designed to facilitate sealing the interior of the box to retard spoilage of the contents.

As such, it is a first object of the present invention to provide a paperboard box with removable identifying indicia.

It is a further object of the present invention to provide such a device wherein a box has a central opening with a plurality of tabs thereon and all of the tabs except one are removed so that the remaining tab describes the contents of the box or a pertinent occasion or message.

It is a still further object of the present invention to provide such a device wherein the tabs are substantially rectangular.

It is a yet further object of the present invention to provide such a device wherein the tabs are triangular or comprise parallelograms.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
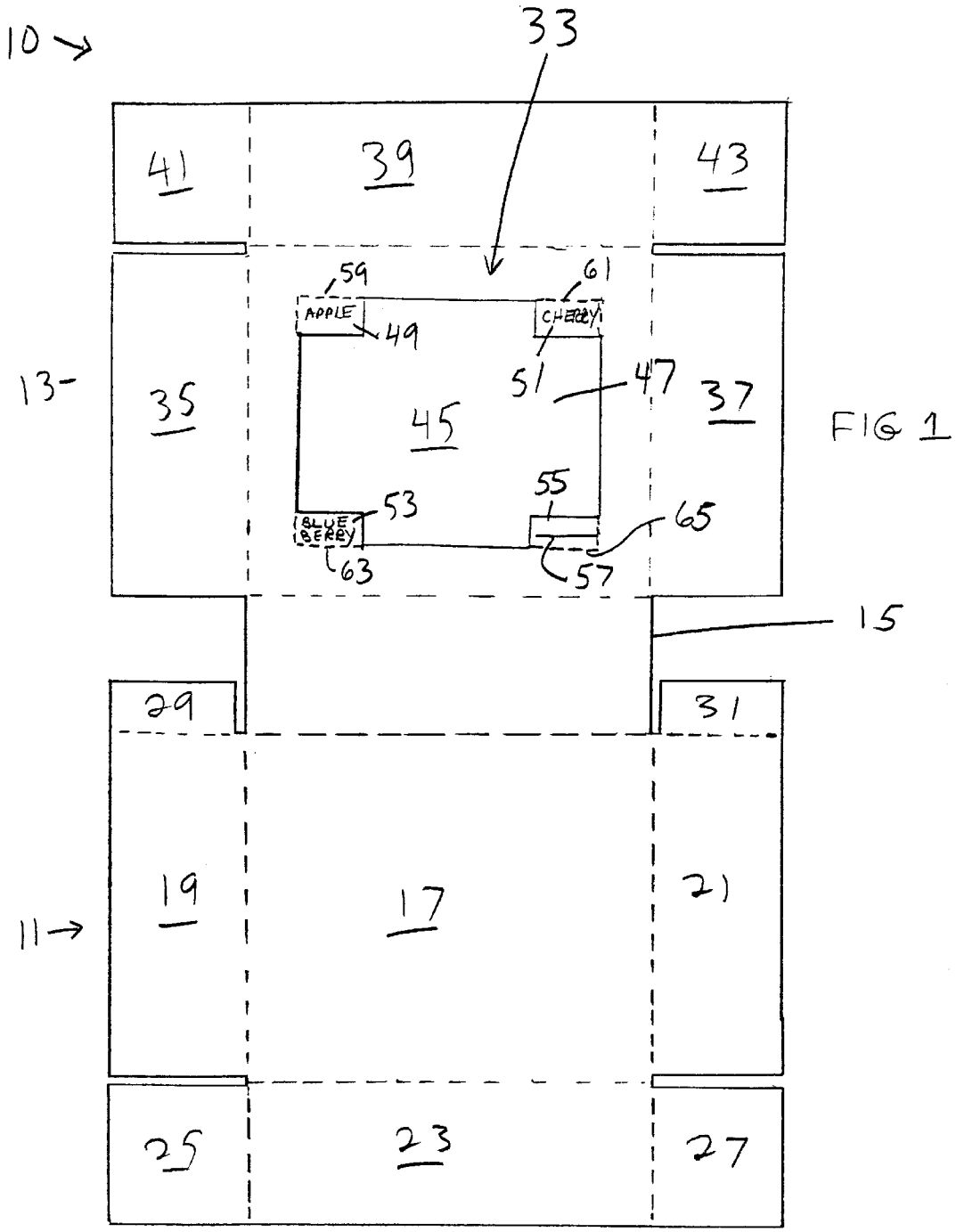
FIG. 1 shows a top view of a paperboard box blank in a flat configuration before it is folded to form a paperboard box.

With reference, first, to FIG. 1, a blank used to make a paperboard box is generally designated by the reference numeral 10 and includes a bottom region 11, a top region 13, and a transition region 15.

The bottom region 11 is used to form the bottom of a finished paperboard box and includes an area 17 surrounded by scored lines that will comprise the bottom of the paperboard box, areas 19 and 21 that will comprise side walls of the finished box, and an area 23 that will comprise the front wall of the box. The transition area 15 will comprise the rear wall of the box.

As should be understood, the area 23 has attached thereto tabs 25 and 27 that will be folded at the scored lines shown so that they can be adhered to the areas 19 and 21, respectively, to assemble the bottom of the box together. The tabs 29 and 31 are folded at the scored lines shown and are adhered to the transition area 15 to complete assembly of the bottom of the box. In a similar fashion, the top region 13 includes a central area 33 that will eventually become the top wall of the cover of the box, areas 35 and 37 that will comprise side walls of the top of the box, and an area 39 that will comprise a front wall of the top of the box. Tabs 41 and 43 laterally disposed with respect to the area 39 are adhered to the areas 35 and 37, respectively, to complete assembly of the top of the eventual box.

With further reference to FIG. 1, the area 33 is seen to include an opening generally designated by the reference numeral 45 and which may, if desired, be covered by a transparent covering 47 such as, for example, cellophane or other thin, flexible, transparent plastic. Each corner of the opening 45 includes a tab, with the tabs being designated by the respective reference numerals 49, 51, 53, and 55. As shown in FIG. 1, the tabs 49, 51 and 53 have indicia thereon indicative of a type of pie intended to be contained within the box made from the blank 10. Thus, the tab 49 includes the wording "apple", the tab 51 includes the wording "cherry", and the tab 53 includes the wording "blueberry". The tab 55 includes a line 57 which may or may not be included with the intent that the user may write a message above the line 57 such as a name for a pie that is not printed on any of the tabs 49, 51 or 53. If desired, instead of pie names, the printing on the tabs 49, 51, 53 or 57 may instead comprise identification of an occasion such as a birthday, anniversary or general congratulations or a general message.

As seen in FIG. 1, each of the tabs is releasably affixed within the opening 45 of the area 33 by scoring, including the scoring 59 for the tab 49, the scoring 61 for the tab 51, the scoring 63 for the tab 53, and the scoring 65 for the tab 55.

In the operation of the embodiment of FIG. 1, a product is placed within the container formed from the blank 10. Of the four tabs, three of them are removed from the opening 45 at the respective scoring shown, leaving only a single tab remaining attached to the area 33. The remaining tab is the one that includes indicia printed thereon (or written thereon in the case of tab 55) relating to either the contents of the box, the occasion celebrated or general congratulations or a message, as examples. In this way, the baker or eventual retailer may easily provide descriptive information concerning the product contained within the box or the occasion to be celebrated in an easy fashion.

Figure 2:
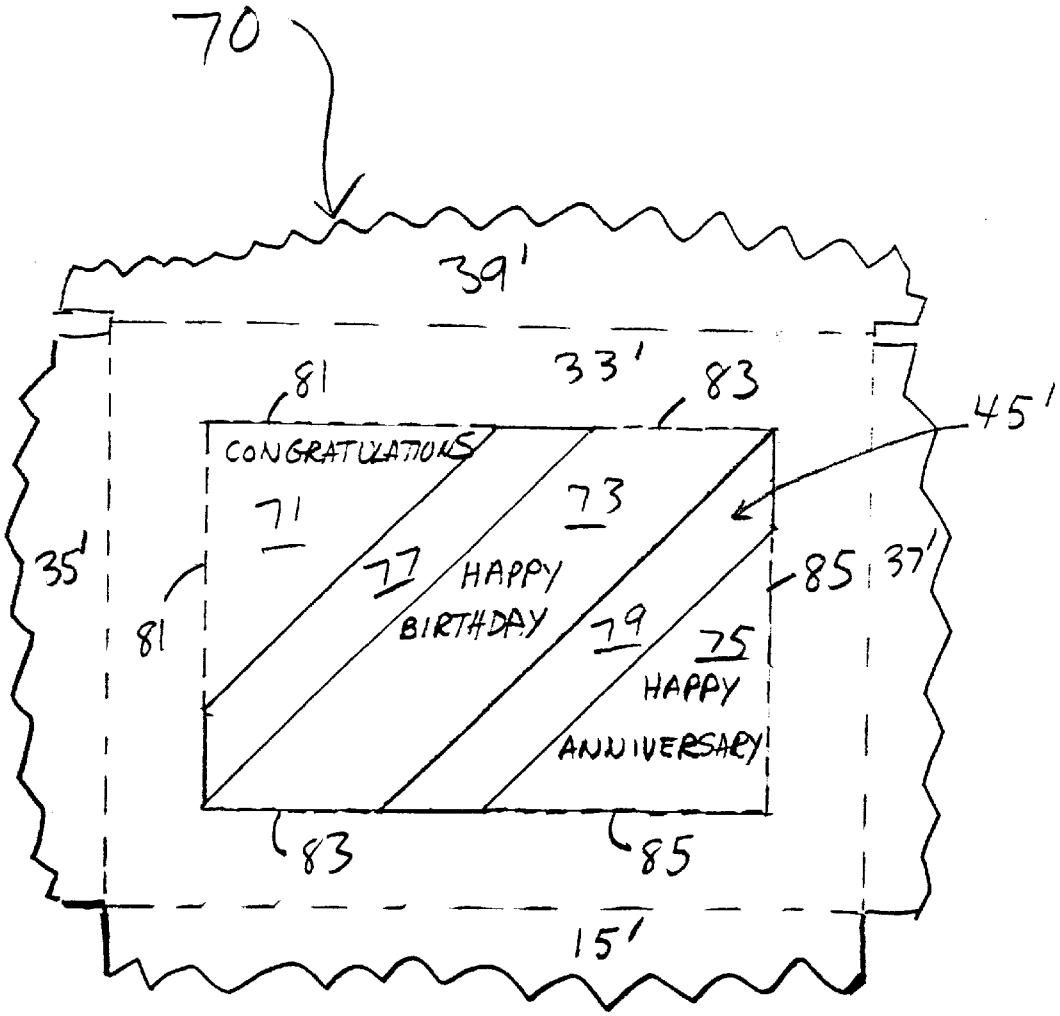
FIG. 2 shows a portion of the view of FIG. 1 but with modifications showing a second embodiment.

With reference to FIG. 2, a second example of the present invention is seen, with like elements being referred to using like primed reference numerals. In FIG. 2, the area 33' has an opening 45' partially obscured by tabs 71, 73 and 75. Between the tabs 71 and 73, a trapezoidal opening 77 is provided. Between the tabs 73 and 75, a trapezoidal opening 79 is provided. The tabs 71 and 75 are generally triangular in shape, whereas the tab 73 comprises a parallelogram.

The tab 71 is affixed to the area 33' by scoring 81. The tab 73 is affixed to the area 33' by scoring 83. The tab 75 is affixed to the area 33' by scoring 85.

As seen in FIG. 2, each tab has indicia thereon relating to an occasion such as "Congratulations" (the tab 71), "Happy Birthday" (the tab 73), and "Happy Anniversary" (the tab 75). Of course, if desired, these indicia may easily be replaced with indicia relating to a description of the contents of the box or any other desired indicia.

In the embodiment of FIG. 2, the food product or other item is placed within the paperboard box made from the blank 70, and two of the three tabs 71, 73 and 75 are removed from the area 33' leaving a single remaining tab having printed thereon a description relating to the contents of the box or the occasion to be celebrated or other information. Of course, if desired, one of the tabs may be provided with an area where the user may hand write descriptive information or have such information suitably printed thereon.

Of course, the teachings of the present invention may be applied to containers made of any desired material including thin plastic.

As such, an invention has been disclosed in terms of preferred embodiments thereof, which fulfill each and every one of the objects of the present invention as set forth hereinabove, and provide new and useful embodiments of a paperboard box with removable identifying indicia of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. An improved package, comprising:

a) a body forming an enclosed space;

b) a plurality of tabs removably attached to said body by L-shaped scoring, at least two of said tabs having printed indicia thereon visible from outside said package;

c) said printed indicia on said tabs describing one of (1) alternative descriptions of products adapted to be placed in said package, (2) alternative occasions to be celebrated or observed, (3) alternative greetings or salutations, or (4) alternative slogans, whereby a user may remove all but one of said tabs, said one of said tabs providing a desired product description or message.

2. The package of claim 1, wherein said body comprises a folded paperboard container, said container having a top surface carrying said tabs.

3. The package of claim 2, wherein said top surface includes an opening, said tabs being located adjacent said opening.

4. The package of claim 3, wherein said tabs are attached to a periphery of said opening by said scoring.

5. The package of claim 1, wherein a top surface of said container includes an opening, said tabs being located adjacent said opening.

6. The package of claim 1, wherein said tabs are rectangular.

7. The package of claim 1, wherein at least one tab is triangular.

8. The package of claim 1, wherein at least one tab is a parallelogram.

9. An improved package, comprising:

a) a body forming an enclosed space;

b) a plurality of tabs removably attached to said body, at least two of said tabs having printed indicia thereon visible from outside said package and at least one additional tab being devoid of indicia whereby desired indicia may be written thereon;

c) said printed indicia on said tabs describing one of (1) alternative descriptions of products adapted to be placed in said package, (2) alternative occasions to be celebrated or observed, (3) alternative greetings or salutations, or (4) alternative slogans, whereby a user may remove all but one of said tabs, said one of said tabs providing a desired product description or message.

* * * * *